US005143316A

United States Patent [19]

Goetz et al.

[11] Patent Number: 5,143,316

[45] Date of Patent: Sep. 1, 1992

[54] SPOOL ASSEMBLY

[75] Inventors: Charles R. Goetz, Carnegie, Pa.; Charles G. Goetz, New York, N.Y.

[73] Assignee: Advanced Products Incorporated, Pittsburgh, Pa.

[21] Appl. No.: 521,046

[22] Filed: May 9, 1990

[51] Int. Cl.[5] ..... B65H 54/553; B65H 75/14; B65H 75/22

[52] U.S. Cl. ..... 242/129.5; 242/116; 242/118.61; 242/129.51; 242/130; 242/139

[58] Field of Search ..... 242/117, 118.6, 118.61, 242/118.4, 115, 116, 71.8, 106, 55, 68.6, 68.4, 80, 82, 83, 129.5, 129.51, 130, 139; 384/220, 416, 444, 448

[56] References Cited

U.S. PATENT DOCUMENTS

| | | | |
|---|---|---|---|
| D. 211,531 | 6/1968 | Elmslie | D41/1 |
| D. 277,260 | 1/1985 | Dickens | D8/358 |
| D. 290,340 | 6/1987 | McCaffrey | D8/357 |
| 1,119,552 | 12/1914 | Trent . | |
| 1,152,278 | 8/1915 | Bowen . | |
| 1,693,876 | 12/1928 | Unruh | 242/68.4 |
| 2,741,442 | 4/1956 | Aupperle | 242/118 |
| 3,108,763 | 10/1963 | Ahlene | 242/115 |
| 3,552,677 | 1/1971 | Hacker | 242/118.61 |
| 3,617,659 | 11/1971 | Freeman | 191/12.2 |
| 3,785,584 | 1/1974 | Crellin, Jr. | 242/118.6 |
| 3,817,475 | 6/1974 | Goldstein | 242/115 |
| 3,822,841 | 7/1974 | Campbell | 242/115 |
| 3,846,887 | 11/1974 | Woods et al. | 29/200 |
| 3,876,073 | 4/1975 | Herbetko | 206/400 |
| 4,172,608 | 10/1979 | Brown | 242/115 X |
| 4,174,077 | 11/1979 | Charles | 242/68.6 |
| 4,221,347 | 9/1980 | Hill | 242/110 |
| 4,345,724 | 8/1982 | Lindell | 242/115 |
| 4,390,139 | 6/1983 | Alexander | 242/55 X |
| 4,629,140 | 12/1986 | LaCasse | 242/71.8 |
| 4,903,913 | 2/1990 | McCaffrey | 242/115 |

FOREIGN PATENT DOCUMENTS

| | | | |
|---|---|---|---|
| 553729 | 1/1957 | Belgium . | |
| 384651 | 3/1972 | Fed. Rep. of Germany | 242/68.4 |
| 2316950 | 10/1974 | Fed. Rep. of Germany . | |
| 464623 | 12/1968 | Switzerland . | |
| 242047 | 11/1925 | United Kingdom . | |
| 440878 | 1/1936 | United Kingdom . | |
| 954686 | 10/1962 | United Kingdom | 242/118.4 |

*Primary Examiner*—Daniel P. Stodola
*Assistant Examiner*—Michael R. Mansen
*Attorney, Agent, or Firm*—Webb, Burden, Ziesenheim & Webb

[57] ABSTRACT

A spool assembly having an elongated spindle and a pair of spaced end plates. Each end of the spindle is formed with a resilient locking arrangement and each end plate is formed with a centrally located opening. A locking arrangement is formed on the periphery of each opening to cooperate with a resilient locking arrangement on an end of the spindle. The resilient locking arrangement on an end of the spindle is engaged with the locking arrangement on the periphery of an opening in an end plate to connect the spindle and the end plates. A moveable slide is located within each end of the spindle to move axially relative to the spindle between a retracted position within the spindle and an extended position partially out of the spindle.

12 Claims, 3 Drawing Sheets

SPOOL ASSEMBLY

BACKGROUND OF THE INVENTION

1. Field of the Invention

The present invention relates generally to a spool assembly for carrying strand or ribbon-like materials such as wire, chain and rope etc. which material is unwound from the spool assembly when it is to be sold or used.

Each spool assembly must be constructed so that it can be supported upon brackets to permit free rotation when unwinding the material. The invention is specifically directed to a knockdown spool assembly of the type having spaced end plates and an elongated spindle connecting the end plates. A locking arrangement member is located on each end of the spindle and is engageable with a locking arrangement formed on an end plate when the spool is assembled. Spool assemblies of this type are shipped in the knocked-down condition and are assembled by the purchasers. This results in less expensive shipping costs. It is essential that the connections between the spindle ends and the end plates permit easy and rapid assembly of the spool and also firmly connect the end plates with the spindle to ensure that the material wound on the spool assembly is maintained on the spool assembly until the material is unwound.

Spool assemblies of the type to which this invention is directed are used in large quantities by both manufacturers and users of strand material such as wire, chain and rope etc. This type of spool is commonly formed from synthetic resin compounds or plastics. The strength required of the spool determines to a certain extent the material from which the end plates and the spindle are made, as well as the dimensions of those pieces. The spool assembly must have sufficient strength to withstand normal handling as occurs in winding, unwinding and shipping without breakage. It has been found that the following materials may be advantageously utilized to form the elements of the spool assembly of the present invention, polyacrylate, high density polyethylene, polyurethane, polyvinyl chloride or polybutadiene-urethane.

2. Related Prior Art

This application is directed to an improvement upon the invention disclosed and claimed in U.S. Pat. No. 4,903,913 granted Feb. 27, 1990 and entitled "Knock-Down Spool Assembly". That patent is owned by the assignee of the instant application and discloses a spool assembly having end plates attached to opposite ends of a spindle by a snap connection arrangement similar to the arrangement utilized in the instant application. The disclosure of Pat. No. 4,903,913 is incorporated herein by reference.

U.S. Pat. No. 4,128,215 discloses a spool having spaced end plates with plugs which are inserted into the ends of a hollow spindle. Each plug includes a flange and a tongue element. The tongue has raised projections positioned for engagement with openings in the spindle. This arrangement provides for the end plates to be locked to the spindle.

SUMMARY OF THE INVENTION

The present invention comprises a spindle and spaced end plates. The spindle includes an end portion at each end and each end plate has a mating arrangement that yieldingly receives and retains a spindle end portion. A slide member is located in each end portion of the spindle for axial movement between an outer extended support position and an inner retracted position.

An objection of the present invention is to provide an improved spool assembly and support brackets wherein the spool assembly is supported by the slides to unwind material from the spool assembly when desired.

Another object of the present invention is to provide the spindle with an extensible and retractable slide at each end for mounting the spool in support brackets and to receive a mandrel for rotating the spool to load it with elongated strand or ribbon-like material.

Another object of the invention is to provide a spool assembly which can be mounted on a standard pipe centered rack when the slides are retracted.

Another object of the invention is to provide a spool assembly wherein the spindle is locked to the end plates of the spool.

These and other features of the invention will become apparent from the following description when read in conjunction with the accompanying drawings wherein like reference characters indicate like parts throughout.

DETAILED DESCRIPTION OF THE PREFERRED EMBODIMENT

Figure 1:
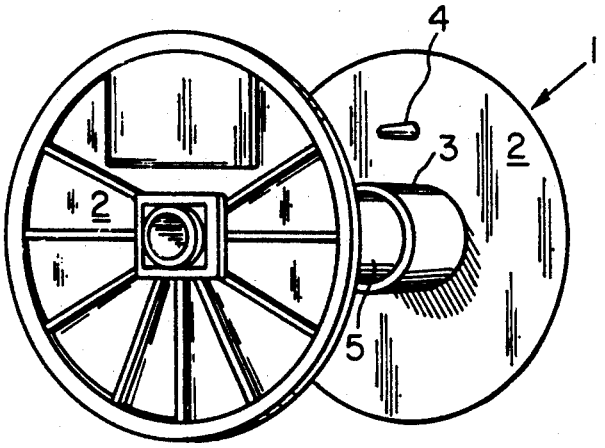
FIG. 1 is a perspective view of the spool assembly according to the present invention.
Figure 2:
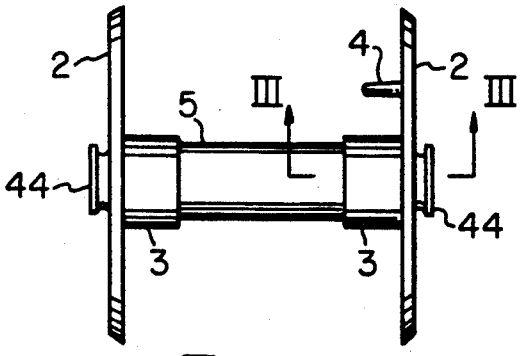
FIG. 2 is an elevation of the spool assembly shown in FIG. 1.

With reference to the drawings, FIGS. 1 and 2 show a spool assembly according to the invention. The spool assembly is indicated generally by reference numeral 1 and has spaced, substantially parallel end plates 2 connected by a hollow cylindrical spindle 5. As described in detail hereinafter, the spindle end portions snap into openings in the end plates to form the spool assembly. The parts of the spool assembly are made from a resilient plastic material such as, for example, polyacrylate, high density polyethylene, polyurethane, polyvinyl chloride or polybutadiene-urethane. Any one of these materials will produce a lightweight spool assembly having a smooth, hard surface.

A hub 3 is formed integrally with each end plate and extends from the inner surface thereof. One end plate has an inwardly projecting finger 4 on the inner surface which may be utilized to secure an end of the material to be wound on the spool assembly in a manner well-known to those skilled in the art.

The central portion of each end plate 2 is formed with a substantially square opening 6 axially aligned with the hub 3. The opening has an outwardly facing notch 7 and a short, axially extending land 8 extending around its periphery. The rear of land 8 is formed as an inwardly facing beveled edge 10 which operates in the manner described hereinafter. The hub 3 formed integrally with each end plate receives an end portion 12 of spindle 5.

Figure 5:
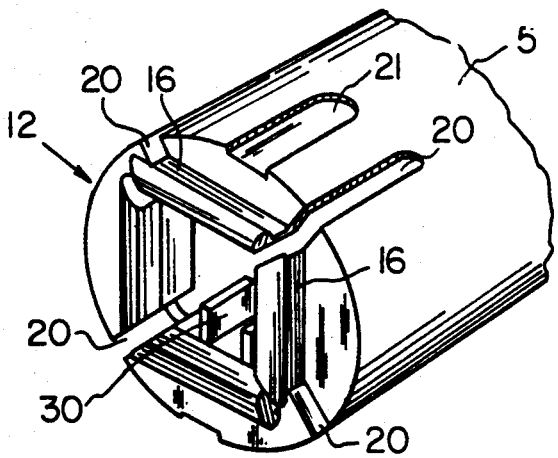
FIG. 5 is a perspective view of an end portion of the spindle.
Figure 6:
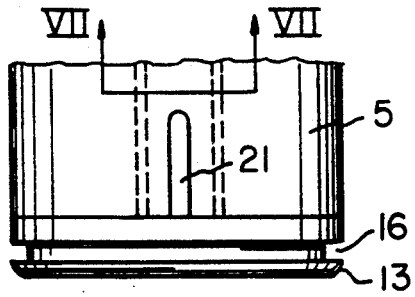
FIG. 6 is a plan view of an end portion of the spindle.
Figure 7:
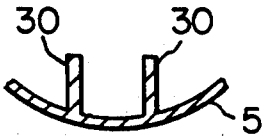
FIG. 7 is a section on line VII—VII of FIG. 6.
Figure 11:
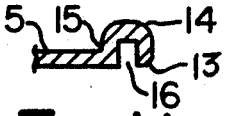
FIG. 11 is a section through the locking arrangement on one end of the spindle.

The spindle 5 is a hollow member having identical opposite end portions 12. As shown in FIG. 5 of the drawings, each end portion is formed with a plurality of axially extending slots 20 and axially extending guide depressions 21. The axially extending slots 20 are angularly spaced 90° from one another and two guide depressions 21 are spaced 180° from each other and are located at 45 angular spacing between two pairs of elongated slots. The guide depressions cooperate with elongated protrusions formed on the inner surface of hub 3 in order to insure that the square end portion of the spindle is properly aligned with the square opening 6 in the end plate. As best shown in FIGS. 5 and 11 of the drawings, each end portion 12 of body 5 has four sides and each side has an integrally formed beveled outer edge 13. The beveled outer edge 13 is integral with a curved wall portion 14 which is connected to the spindle 5 by a flat radial portion 15. A groove 16 is formed in each side of the end portion 12 of the spindle. Upon assembly of the spool assembly, the beveled edge 10 on end plate opening 6 is placed adjacent to the beveled edge 13 on a side of the end portion 12 of spindle 5 so that when longitudinal pressure is exerted on the spindle and the end plate, the beveled edge 10 of opening 6 in the end plate forces the four sides of the spindle end portion 12 inwardly and permits the grooves 16 on the spindle end portion to snap over the land 8 on the end plate and firmly retain the spindle on the end plate. The projections are radially yieldable because of slots 20; the inherent resiliency of the material from which the spindle is constructed and the dimensions of the material from which the spindle end portions are molded. Thus, the four grooves 16 which embrace the land 8 of the square opening 6 in the end plate prevent rotation between the spindle and the end plate and the parts are interlocked to form a spool assembly.

The inner surface of each spindle end portion 12 has a pair of spaced, elongated axially extending guides 30 located thereon. When the spindle halves are assembled, the guides are angularly spaced 180° from each other. The guides receive lugs 41 which extend radially outward from a slide 32 in order to permit slide 32 to move in the axial direction along the spindle while preventing rotation of the slide relative to the spindle and maintaining the relative angular position between the slide and the spindle.

Figure 3:
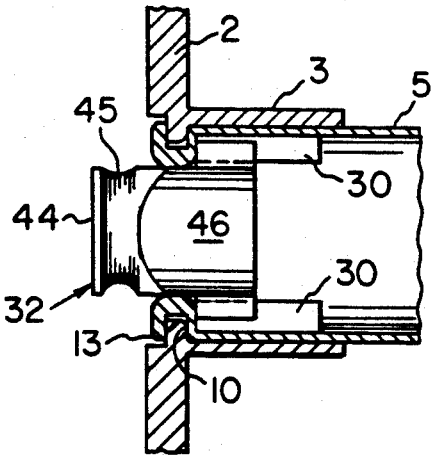
FIG. 3 is a partial section on line III—III of FIG. 2 with the slide in the extended position.
Figure 4:
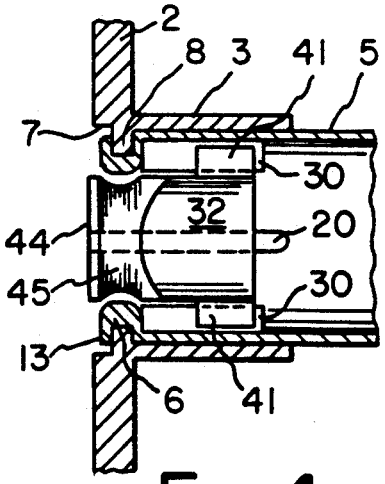
FIG. 4 is a partial section similar to FIG. 3 with the slide in the retracted position.
Figure 8:
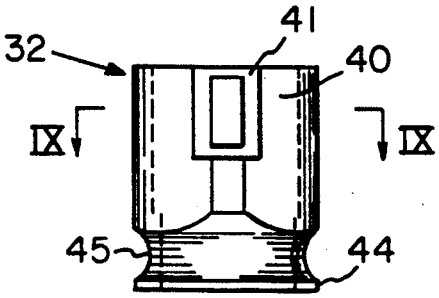
FIG. 8 is a plan view of the slide.
Figure 9:
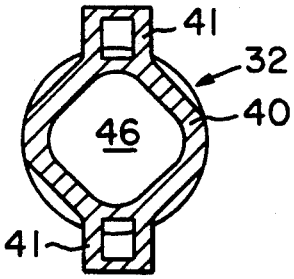
FIG. 9 is a section on line IX—IX of FIG. 8.
Figure 10:
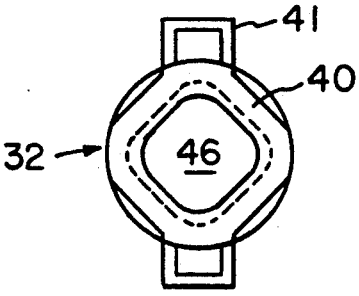
FIG. 10 is an end view of the slide.

A slide 32 is shown in detail in FIGS. 8–10 of the drawings and is shown in the spindle end portion in FIGS. 3 and 4 of the drawings. Each slide 32 consists of a member having a square body 40 with the radially outward extending lugs 41 located on the inner portion of the square body. Each lug has a width slightly smaller than the spacing between guides 30 on the inner surface of the spindle end portions. This permits the slide to move axially relative to the spindle. The outer end 44 of each slide is circular and a recessed annular neck 45 is formed between the circular end 44 and the square body 40. An axially extending square passage 46 extends completely through the slide from end to end. The passage has a square configuration to receive a mandrel to rotate the spool assembly when material is being wound thereon.

When the slide is in its retracted position, as shown in FIG. 4 of the drawings, the neck 45 is located within the spindle end portion 12 adjacent the curved wall portion 14. It is important that there is sufficient clearance between the exterior of neck 45 and the curved wall portion 14 on the spindle end portion to permit groove 16 to snap inwardly when the beveled edges 13 on the spindle end portion and the beveled edge 10 on the end plate are engaged in order to interlock the spindle and the end plate. If sufficient clearance is not available, it will not be possible for grooves 16 to move inwardly a sufficient extent to permit the interlock, and hence, the spool assembly cannot be assembled.

Figure 12:
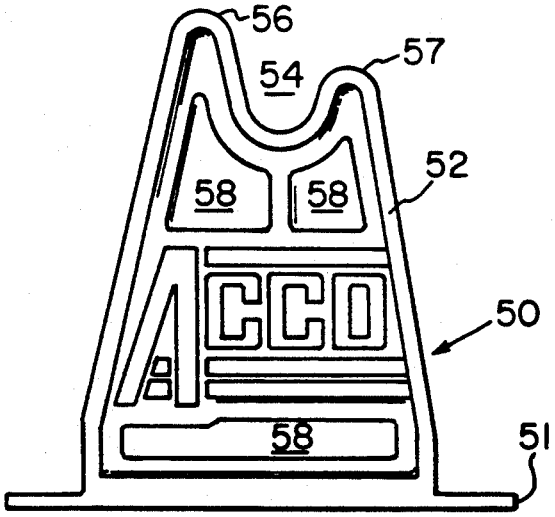
FIG. 12 is a front view of a mounting bracket for a spool.
Figure 13:
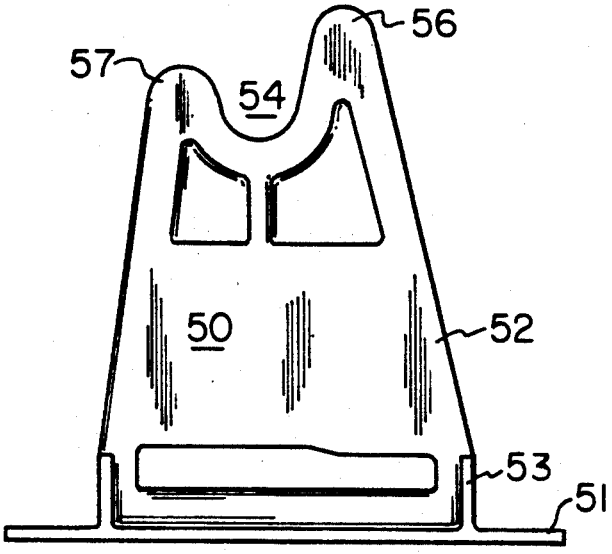
FIG. 13 is a rear view of the mounting bracket shown in FIG. 12.
Figure 14:
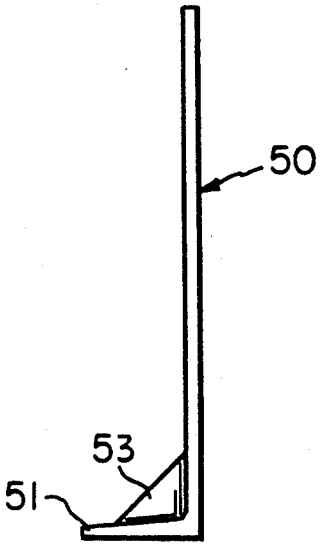
FIG. 14 is an end view of the mounting bracket shown in FIG. 12.
Figure 15:
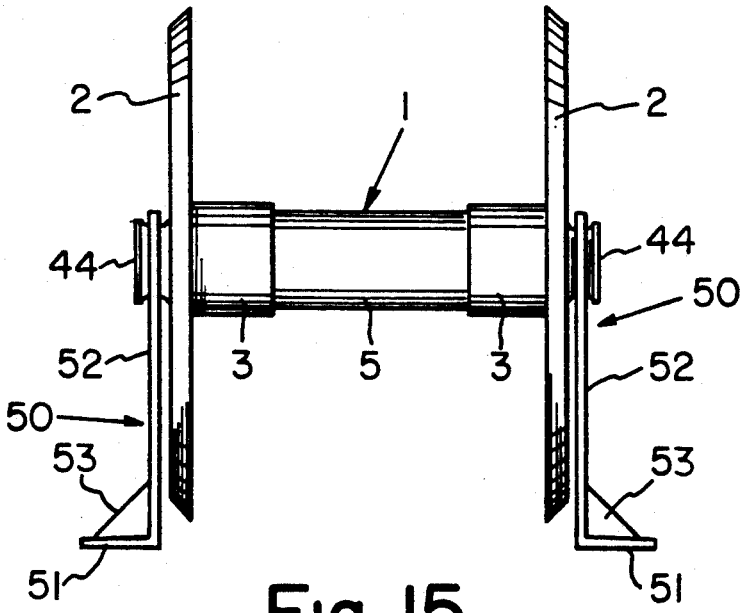
FIG. 15 is an elevation of a pair of mounting brackets supporting a spool assembly.

When a spool assembly is loaded and is to be unwound, it may be supported in a pair of spaced mounting brackets 50 such as shown in FIGS. 12–15. The mounting bracket shown in FIG. 12 is utilized to support the right-hand end of the spool and consists of a base member 51 and a vertical support member 52. Gussets 53 extend between the upper surface of base member 51 and the rear surface of support member 52. The support member has an upwardly-opening, substantially U-shaped notch 54 formed in its upper edge and the forward end 56 of the notch is higher than the rear end 57 so that when a spool assembly is rotated to unwind the material therefrom, it will not be pulled or lifted out of the notch. In order to minimize the expense of molding the bracket members, cutouts 58 are formed therein. The name of the selling company, Acco, is molded directly in the outer surface of the support bracket for advertising purposes. While the right-hand mounting bracket is shown in FIGS. 12–14 of the drawings, it will be understood by those skilled in the art that the left-hand mounting bracket is a mirror image of the right-hand mounting bracket.

It will be understood that after a spool assembly has been loaded with material, it is placed by the retailer or the user in a pair of spaced mounting brackets 50 with slides 32 in the extended position so that the neck 45 of each slide rests in an open top notch 54. Thus, when material is to be unwound from the spool assembly, the necks 45 of the slides will rotate in the open top notches 54 to permit the desired amount of material to be unwound.

The spool assembly may also be mounted on a standard pipe centered rack such as used by some retailers. In this mounting arrangement, the slides are maintained in the retracted position and a pipe or other axle is place through the spindle and extends beyond each end plate to mount the spool assembly in the rack.

As will be readily understood by those skilled in the art, the various items described hereinabove are formed by molding and it is therefore necessary to mold the spindle in elongated separate 180° halves. The halves are formed with guide holes and pins along their axial edges in order to align the halves when they are joined to form the spindle. Such is a standard procedure in the plastic molding art and forms no part of the instant invention.

While the invention has been described hereinabove in conjunction with the drawings, it is to be understood that the invention may be otherwise embodied within the scope of the appended claims.

We claim:

1. A spool assembly having an elongated spindle with an end portion at each end, resilient locking means formed on each end portion of said spindle, a pair of spaced end plates having an inner face, a centrally located opening formed in each of said end plates and locking means formed on the periphery of each of said openings adapted to cooperate with said resilient locking means on said end portions of said spindle, a hub extending from the inner face of each of said end plates adapted to receive an end portion of said spindle, each of said end portions of said spindle being located within a hub and said resilient locking means on said end portion engaged with said locking means on the periphery of one of said openings in one of said end plates and a moveable slide located within each of said end portions of said spindle, each of said slides adapted to move axially relative to said spindle whereby each of said slides is in the retracted position when said spool assembly is being loaded and may be moved to the extended position when said spool assembly is being unloaded, and a means on each of said slides adapted to be aligned with said resilient locking means formed on an end portion of said spindle when each of said slides is in a retracted position within one of said end portions of said spindle for providing sufficient clearance between the exterior of said means on said slide and said resilient locking means formed on the end of said spindle to permit the resilient locking means on each of said end portions of said spindle to move inwardly when said resilient locking means on each of said end portions of said spindle and the locking means formed on the periphery of each of said openings are engaged to interlock the spindle and the end plate.

2. A spool assembly as set forth in claim 1, wherein each of said slides has a square body portion and a rounded end portion and said rounded end portions are adapted to support said spool assembly during unwinding.

3. A spool assembly as set forth in claim 2, wherein said means on said slide is an annular neck between said rounded end portion of said slide and said square body portion of said slide whereby said necks are adapted to support said spool assembly.

4. A spool assembly as set forth in claim 1, wherein the inner surface of each of said end portions of said spindle is formed with axially elongated guide means and each of said slides is formed with spaced, radially outward extending lugs, the angular spacing of said guide means and the angular spacing of said lugs being the same so that said lugs are retained in said guide means during axial movement of said slides relative to said spindle between said retracted position of said slides and said extended position of said slides.

5. A spool assembly as set forth in claim 1, wherein each of said slides has an elongated passage extending therethrough and said passage has a square cross section whereby said elongated passage is adapted to receive a mandrel to drive said spool assembly when said spool assembly is being loaded.

6. A spool assembly as set forth in claim 1, wherein the periphery of said opening in each of said end plates is formed with an outwardly-opening notch, an axially extending land and a rear beveled edge on said land.

7. A spool assembly as set forth in claim 6, wherein the end of each of said end portions of said spindle is formed with four sides and each side has a rounded curved wall portion having a beveled outer edge and a radial inner wall connecting said curved wall portion to said spindle whereby said beveled outer edges on said sides of said end portion of said spindle cooperates with said beveled edge on the periphery of said opening in said end plate to radially compress said end portion of said spindle whereby said end portion of said spindle interlocks with the periphery of said opening of said end plate.

8. A spool assembly as set forth in claim 6, wherein said openings in said end plates are substantially square and said end portions of said spindle are substantially square.

9. A spool assembly as set forth in claim 1, wherein the periphery of said opening in each of said end plates is formed with an outwardly-opening notch, an axially extending land and a rear beveled edge on said land, the end of each of said end portions of said spindle is formed with four sides and each side has a rounded curved wall portion having a beveled outer edge and a radial inner wall connecting said curved wall portion to said spindle whereby said beveled outer edges on said sides of said end portion of said spindle cooperates with said beveled edge on the periphery of said opening in said end plate to radially compress said end portion of said spindle whereby said end portion of said spindle interlocks with the periphery of said opening of said end plate.

10. A spool assembly as set forth in claim 9, wherein said openings in said end plates are substantially square and said end portions of said spindle are substantially square.

11. A spool assembly having an elongated spindle with opposed end portions, resilient locking means formed on each of said end portions of said spindle, a pair of spaced end plates having an inner face and an opposed outer face, a centrally located opening formed in each of said end plates and locking means formed on the periphery of each of said openings adapted to cooperate with said resilient locking means on said end portions of said spindle, a hub extending from said inner face of each of said end plates adapted to receive one of said end portions of said spindle, each of said end portions of said spindle being located within a hub and said resilient locking means on said end portion engaged with said locking means on the periphery of one of said openings in one of said end plates, an elongated slide located within each of said end portions of said spindle adapted to move axially relative to said spindle, whereby each of said slides is in a retracted position when said spool assembly is being loaded and may be moved axially into the extended position when said spool assembly is to be unloaded, and a reduced diameter portion on each of said slides adapted to be aligned with said resilient locking means formed on an end portion of said spindle when each of said slides is in a retracted position within one of said end portions of said spindle to provide sufficient clearance between the exterior of said reduced diameter portion and the locking means formed on the periphery of each of the openings formed in each of said end plates to permit the resilient locking means one each of said end portions of said spindle to move inwardly when the resilient locking means on said end portions of said spindle and the locking means formed on the periphery of said openings are engaged to interlock the spindle and the end plate.

12. The combination of a pair of spaced support brackets and a spool assembly supported in said support brackets, each of said support brackets having a base member and a support member upstanding from said base member, said support member having an upwardly-opening, U-shaped notch formed therein, said spool assembly having a hollow elongated spindle body, means for connecting each end of said hollow spindle body to an end plate and an opening in each of said end plates axially aligned with said hollow spindle body, an axially moveable slide supported in each end of said hollow spindle body for extension out of said hollow spindle body through said opening in said end plate and retraction into said hollow spindle body, a recessed annular neck adjacent one end of said slide to provide sufficient clearance between the exterior of said reduced diameter portion and said means for connecting each end of said spindle body to an end plate to permit said means on said end portions of said spindle body to move inwardly when the means for connecting said spindle body and the locking means formed on the periphery of said openings are engaged to interlock said spindle body and an end plate and said annular neck being supported in one of said notches when said slides is in the extended position.

* * * * *

UNITED STATES PATENT AND TRADEMARK OFFICE

CERTIFICATE OF CORRECTION

PATENT NO. : 5,143,316
DATED : September 1, 1992
INVENTOR(S) : Charles R. Goetz, et. al.

It is certified that error appears in the above-indentified patent and that said Letters Patent is hereby corrected as shown below:

Column 3, line 19, "45" should read -- $45^{\circ}$--.

Signed and Sealed this

Nineteenth Day of October, 1993

*Attest:*

BRUCE LEHMAN

*Attesting Officer*

*Commissioner of Patents and Trademarks*